US008157612B2

(12) United States Patent
Rehkemper et al.

(10) Patent No.: US 8,157,612 B2
(45) Date of Patent: Apr. 17, 2012

(54) SYSTEM TO DIRECT MOVEMENT OF A DANCING FIGURE

(75) Inventors: Steven Rehkemper, Chicago, IL (US); Ryan Kratz, Oak Park, IL (US)

(73) Assignee: Rehco, LLC, Chicago, IL (US)

( * ) Notice: Subject to any disclaimer, the term of this patent is extended or adjusted under 35 U.S.C. 154(b) by 395 days.

(21) Appl. No.: 12/369,528

(22) Filed: Feb. 11, 2009

(65) Prior Publication Data

US 2009/0203291 A1 Aug. 13, 2009

Related U.S. Application Data

(60) Provisional application No. 61/027,851, filed on Feb. 12, 2008.

(51) Int. Cl.
*A63J 19/00* (2006.01)

(52) U.S. Cl. ..... 446/331; 446/365; 446/366; 446/379; 446/352

(58) Field of Classification Search ..... 446/330, 446/365–367, 359–360, 379–380, 382–383, 446/376, 390, 358, 352–354, 396, 331; *A63H 3/20, A63H 3/11*

See application file for complete search history.

(56) References Cited

U.S. PATENT DOCUMENTS

| | | | | |
|---|---|---|---|---|
| 2,585,467 | A * | 2/1952 | Huth | 40/418 |
| 2,725,671 | A * | 12/1955 | Morsch | 446/352 |
| 4,824,416 | A * | 4/1989 | Chun-Hoi et al. | 446/298 |
| 4,889,027 | A * | 12/1989 | Yokoi | 84/635 |
| 5,870,842 | A * | 2/1999 | Ogden et al. | 40/411 |
| 6,652,351 | B1 * | 11/2003 | Rehkemper et al. | 446/354 |
| 7,815,485 | B2 * | 10/2010 | Moothedath et al. | 446/352 |

* cited by examiner

*Primary Examiner* — Gene Kim
*Assistant Examiner* — Matthew B Stanczak
(74) *Attorney, Agent, or Firm* — Adam K. Sacharoff

(57) ABSTRACT

The present invention provides for an interactive figure with several pivot regions in the ankles, knees and hips. Two drive mechanisms are housed within a base to drive movement of the lower portion of the figure while an additional drive mechanism is included within the torso of the doll to drive movement of the arms and head. Additionally, gear mechanisms are included within the base and the figure to transfer movement from the drive mechanisms to the figure along with various electronics. In response to a user's input or a preprogrammed play routine, the figure will respond with various movement and audio content.

18 Claims, 11 Drawing Sheets

5
210
10
200
215
215
75
60
60
70
70
115
115
65
65
15
15
20

10
220
20
45
Figure
Base
Speaker
35
210,215
Arms and Head
Third Motor
Integrated Circuit
245
Processor(s)
250
Memory
First Motor
Feet and Legs
Second Motor
Operation Members
Power Source
15,60
55
32
40

SYSTEM TO DIRECT MOVEMENT OF A DANCING FIGURE

This application claims priority to provisional application 61/027,851 filed Feb. 12, 2008.

FIELD OF THE INVENTION

The present invention relates generally to motorized interactive toys and more particularly to a system to direct movement of dolls and figures that are mechanically animated.

BACKGROUND OF THE INVENTION

Animated dolls are popular toys for children and improving the interaction between a doll and child to resemble a more life-like interaction is desired by those in the industry. Miniaturization of electronic circuitry has enabled the incorporation of electrical components to be included in the interior of a doll. Those concerned with the development of animated dolls desire improvements in the coordinated movement of legs, arms, hands, etc. along with the addition of music and sound effects. Examples of various, interactive dolls are found in U.S. Pat. Nos. 4,676,764, 5,176,560, 5,259,806 and 5,273,479.

The present invention includes improvements in the animation of dolls and interaction with children by addressing shortcomings in the prior art due to size constraints while providing a system to direct animated movements for use in a toy figure that creates a life-like interaction utilizing mechanical animation, electrical direction and sound to enhance a child's play experience.

BRIEF DESCRIPTION OF THE DRAWINGS

A fuller understanding of the foregoing may be had by reference to the accompanying drawings, wherein:

FIG. 1 is a front perspective view of a figure on a base in accordance with an embodiment for a system to direct movement of a dancing figure;

DETAILED DESCRIPTION OF THE EMBODIMENTS

Figure 2:
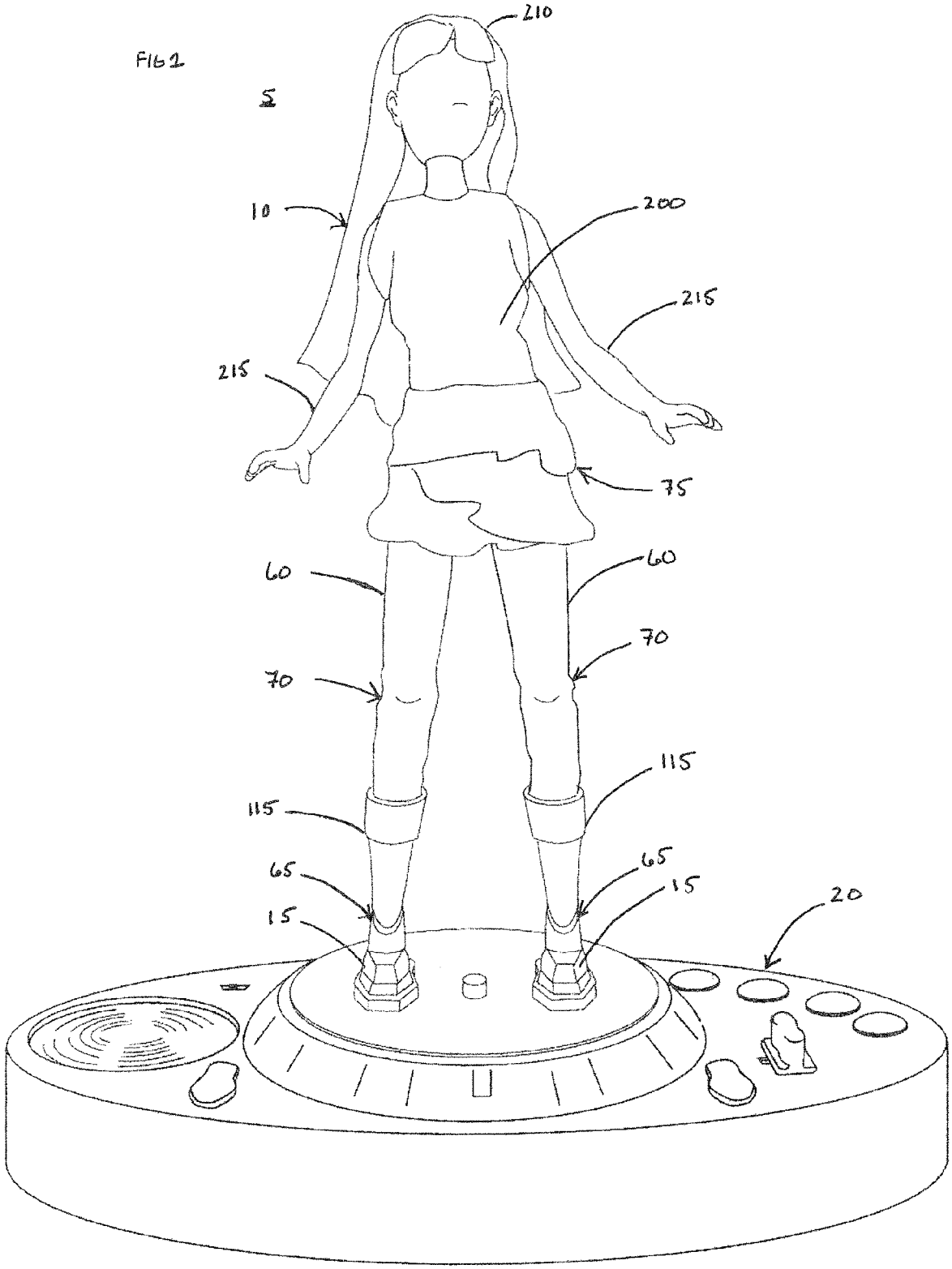
FIG. 2 is an exploded view of a figure, illustrating the components of the figure, in accordance with an embodiment for a system to direct movement of a dancing figure.
Figure 2:
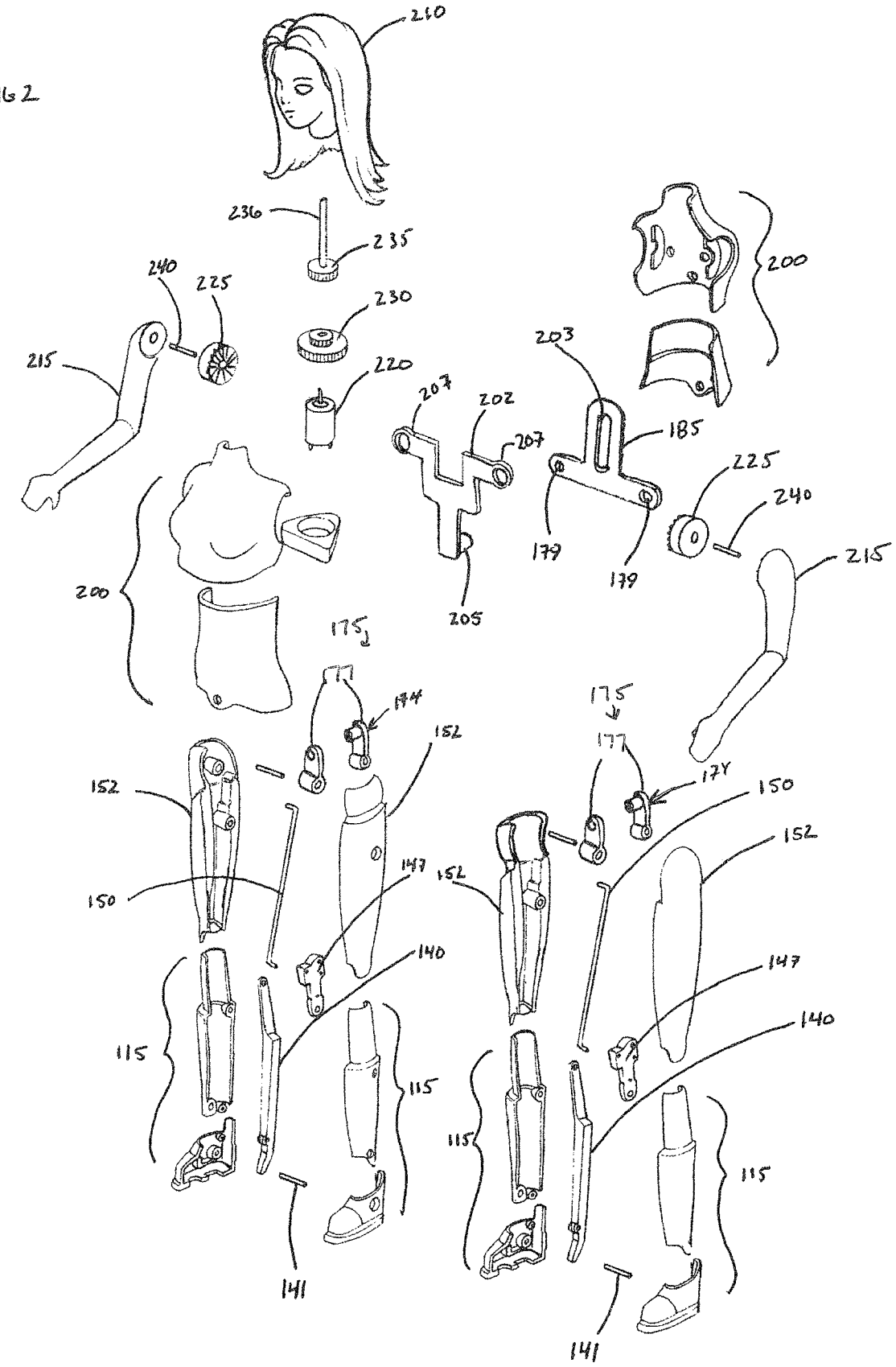

While the invention is susceptible to embodiments in many different forms, there are shown in the drawings and will described herein, in detail, the preferred embodiments of the present invention. It should be understood, however, that the present disclosure is to be considered an exemplification of the principles of the invention and is not intended to limit the spirit or scope of the invention, claims and/or embodiments illustrated.

Referring now to FIG. 1 a system 5 to direct movement of a dancing FIG. 10 is shown in accordance with the embodiments and disclosures herein below. While the FIG. 10 is shown as a female doll, other external features or characters not shown may also be contemplated, such as robots, male characters, insects, animals, etc.

As illustrated, the FIG. 10 includes a pair of feet 15 that are removeably attachable to a base 20 (described in greater detail below). The base 20 is an important aspect of the invention especially for the movement of the FIG. 10. In one embodiment, the base 20 causes movements through a series of linkages and housings that move the FIG. 10. The linkages and housings are pivotally connected to each other at specific areas defined in the ankle region 65, knee region 70 and hip region 75, which permit the legs 60 to bend or pivot at those regions. The FIG. 10 is removable from the base 20 for typical static play, such as changing clothes, etc.

Continuing to refer to FIG. 1, the feet 15 are separately connected to ankle regions 65 that are part of the figure's boot housings 115. Individual legs connect the boot housings through a knee region 70 to the hip regions 75. The FIG. 10 further includes a torso housing 200 which connect the hip regions 75 to the head 210 and to a pair of arms 215. The interior components of the FIG. 10 are best shown and described with reference to FIG. 2.

FIG. 2 shows that the legs, thighs, and torso of the FIG. 10 houses various linkages and components that move the FIG. 10 when the system 5 is operating. The legs 60 are broken into two regions the thigh region and lower leg region. The lower leg region includes the boot housing 115 that includes a calf linkage 140, while the thigh region includes a thigh housing 152 that includes a thigh linkage 150. The calf linkage 140 is secured at the lower end by pin 141, while the upper end is secures to the lower end of the thigh linkage to a knee connector 147. The upper end of the thigh linkage 150 is secured to a portion of the hip connector 175. The hip connector 175 includes a pair of parallel sides 177 that secure to an aperture 179 on a T-bar mount 185. The T-bar mount 185 further includes a channel 203 (explained shortly below). The T-bar mount is housed in the lower section of the torso housing 200.

The torso housing 200 also contains a y-bar mount 202 which includes on its lower end a knob 205 that fits within the channel 203 of the T-bar mount 185. Ends 207 of the Y-bar mount 202 are secured within the torso housing 200. The upper portion of the torso housing 200 also houses a motor 220 that is used to move the arms and head. The motor 220 drives a combo gear 230 that meshes to a pair of crown gears 225 and a neck gear 235. The crown gears 225 separate move the arms 215, which are connected to pins 240, up and down.

This is done while the head 210 moves side to side by virtue of its connection to the neck post 236. Greater detail of the movement of the FIG. 10 will be explained below.

Figure 3:
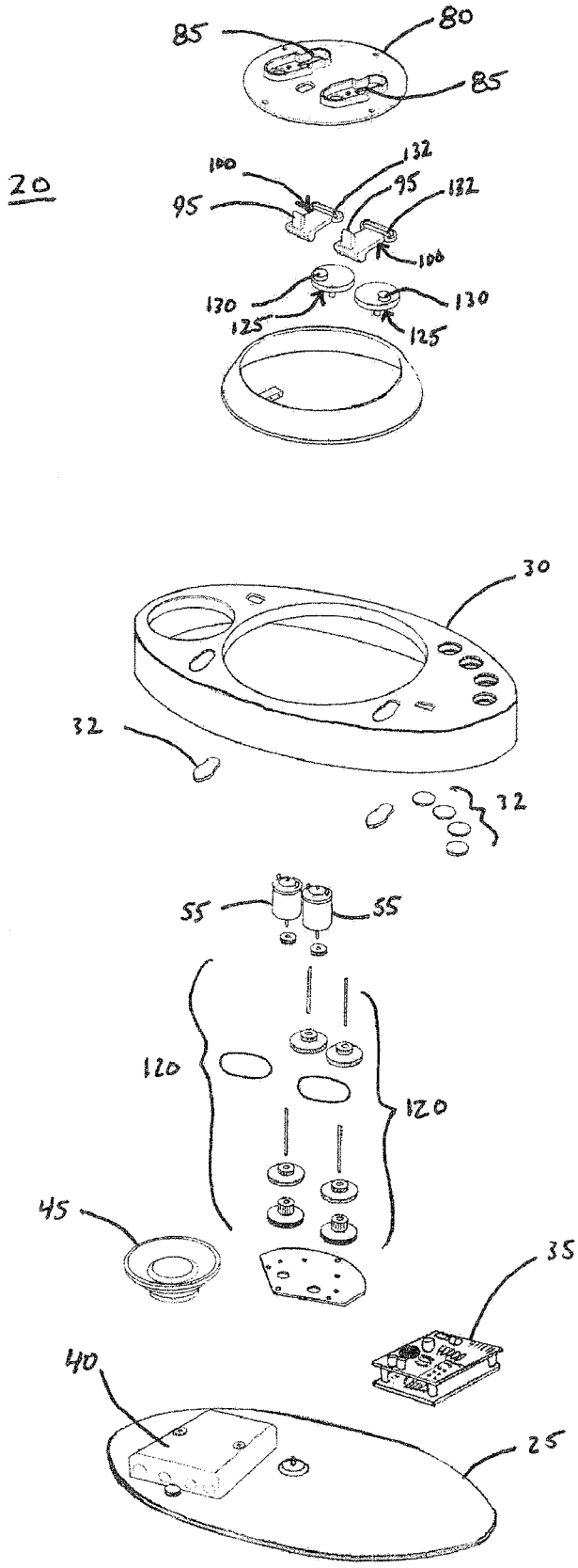
FIG. 3 is an exploded view of a base, illustrating the components of the base in accordance with an embodiment for a system to direct movement of a dancing figure.
Figure 4A:
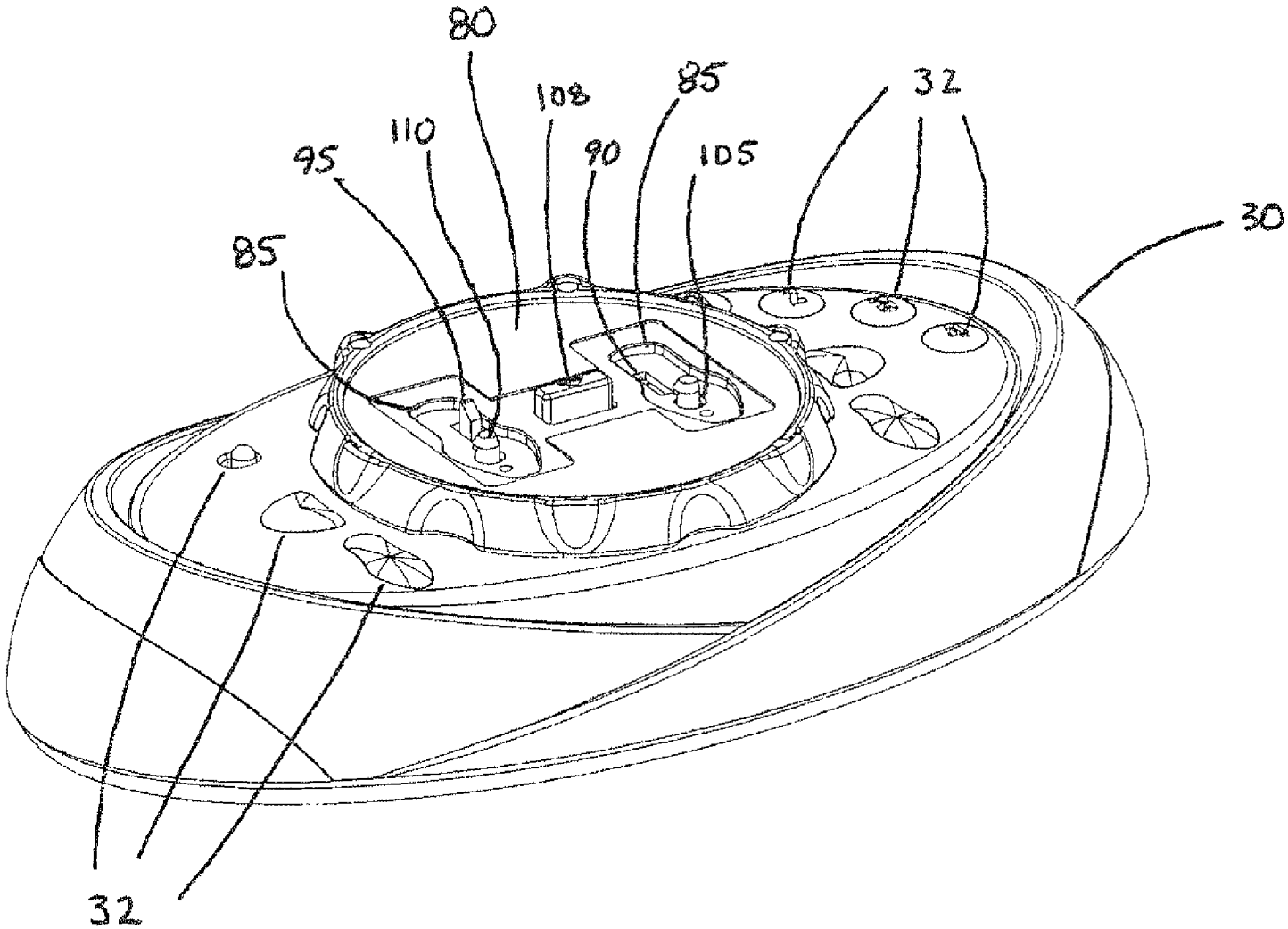
FIG. 4*a* is a perspective view of a base for in accordance with an embodiment for a system to direct movement of a dancing figure.
Figure 4B:
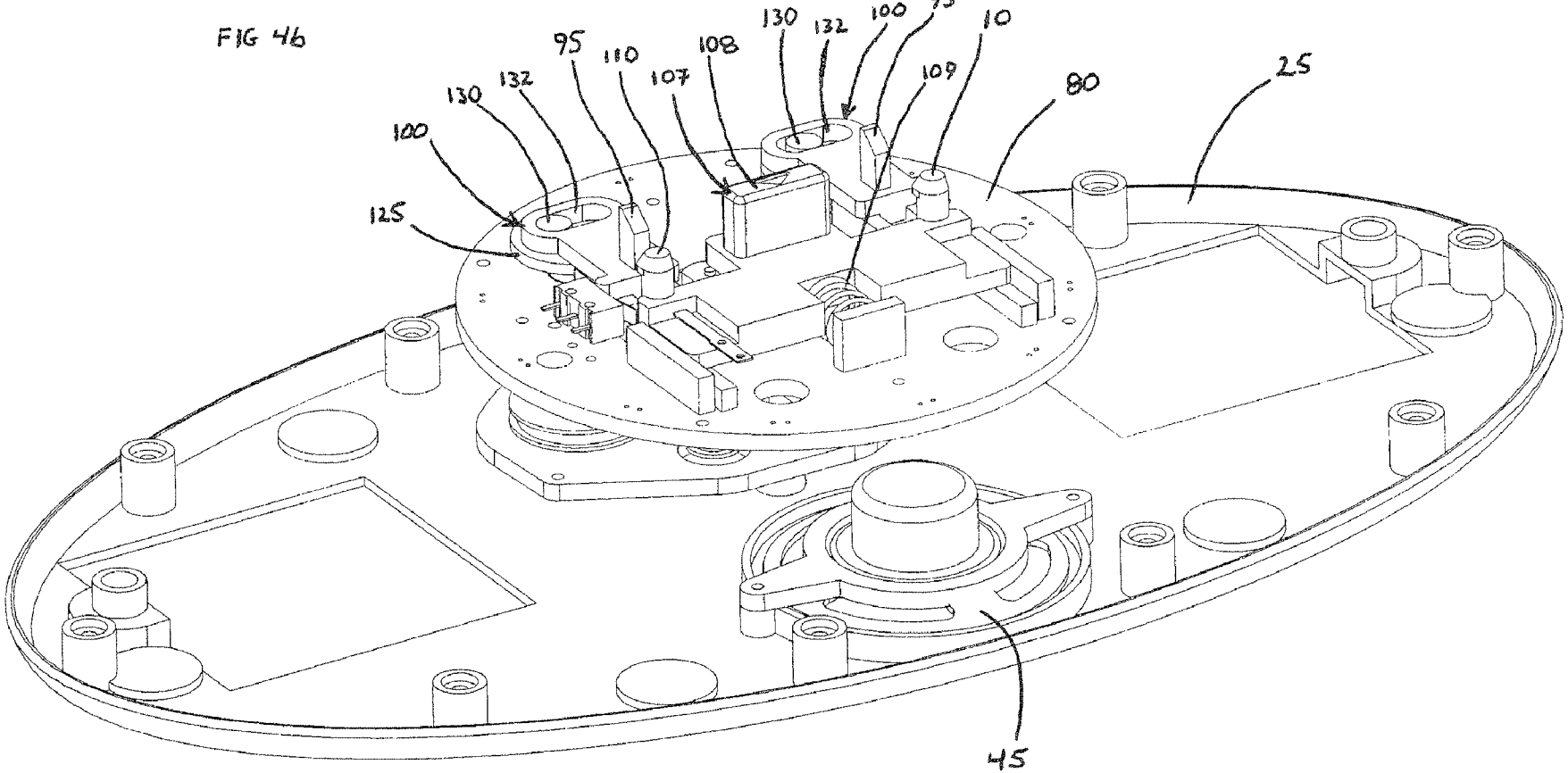
FIG. 4*b* is a front perspective view of the internal components of the base from FIG. 4*a* where the housing is removed in accordance with an embodiment for a system to direct movement of a dancing figure.
Figure 4C:
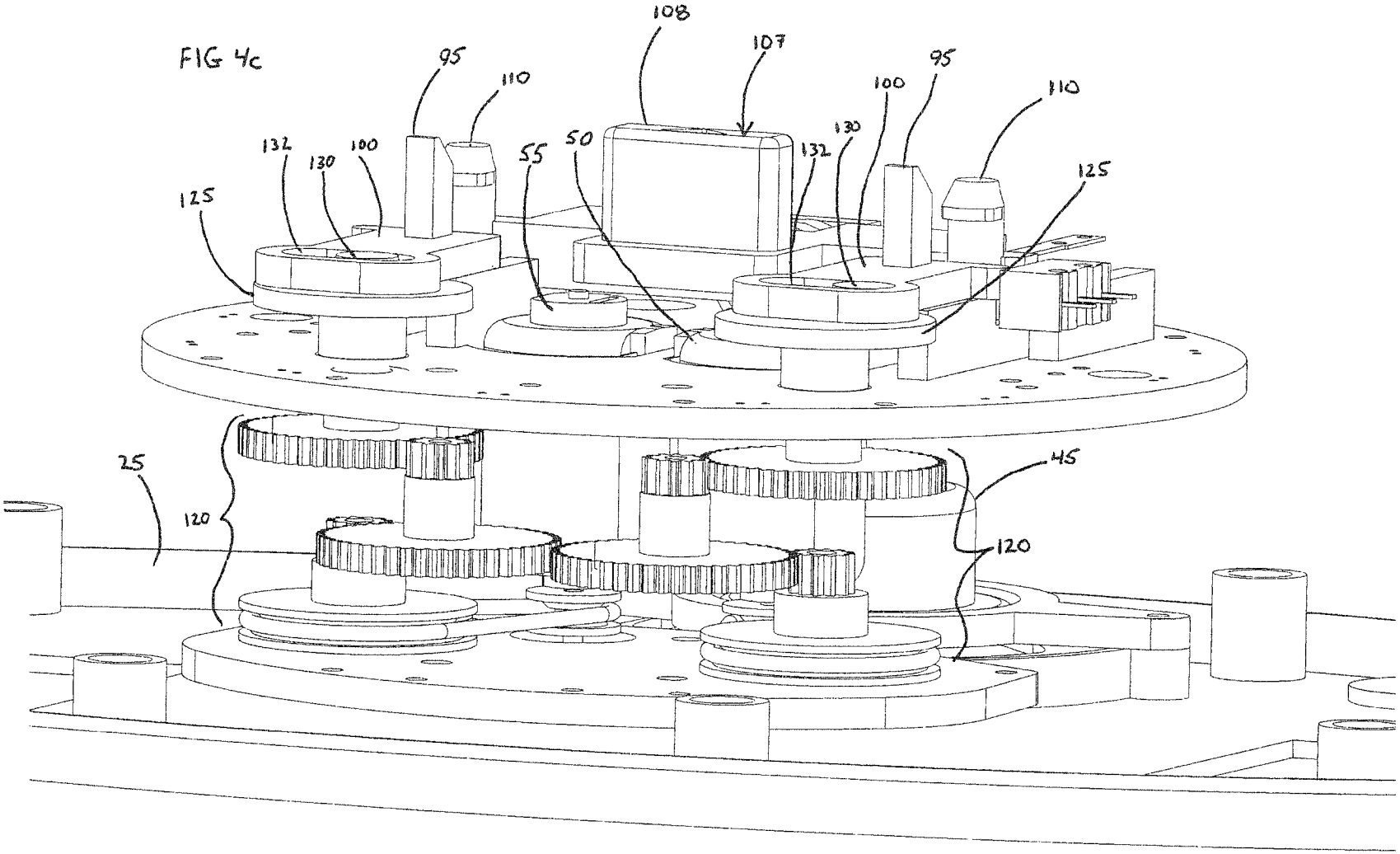
FIG. 4*c* is a rear perspective view of FIG. 4*b*, illustrating a drive mechanism and gear train assembly in accordance with an embodiment for a system to direct movement of a dancing figure.

Referring now to FIGS. 3 through 4*c*, the base 20 includes a base plate 25, a housing 30 and a plurality of operation members 32. An integrated circuit (IC) 35, power source 40 and speaker 45 are secured to the base plate 25. First and second drive mechanisms are housed within the base 20 and utilize a first motor 50 and a second motor 55 to power each leg 60 independently of the other. The first and second motors 50 and 55 are in operable communication with two sets of gear trains 120. The two sets of gear trains 120 transfer movement to two upper gears 125, in which both include a cam 130. Each cam 130 extends through a channel 132 in a rotation linkage 100, that when the cam moves causes the rotation linkage 100 to rock back and forth. The rotation linkage 100 also includes a tab 95. The tab 95 extends out through an upper turntable plate 80 that specifically includes footprints 85 sized to receive the feet of the FIG. 10. More specifically the tab 95 extends through a footprint channel 90 in the upper turntable plate 80. In addition to the tab 95 a post 110 also extends through a footprint aperture 105. The tab 95 and post 110 help keep the FIG. 10 secured to the upper turntable plate 80. By locking onto apertures in the bottom of the feet. To release the FIG. 10 the user can push a flange 108 defined by an engagement mechanism 107. The engagement mechanism 107 includes a spring 109 that biases the engagement mechanism 107 such that the feet are secured in place. Pushing the flange 108 compresses the spring and releases the feet.

Figure 5A:
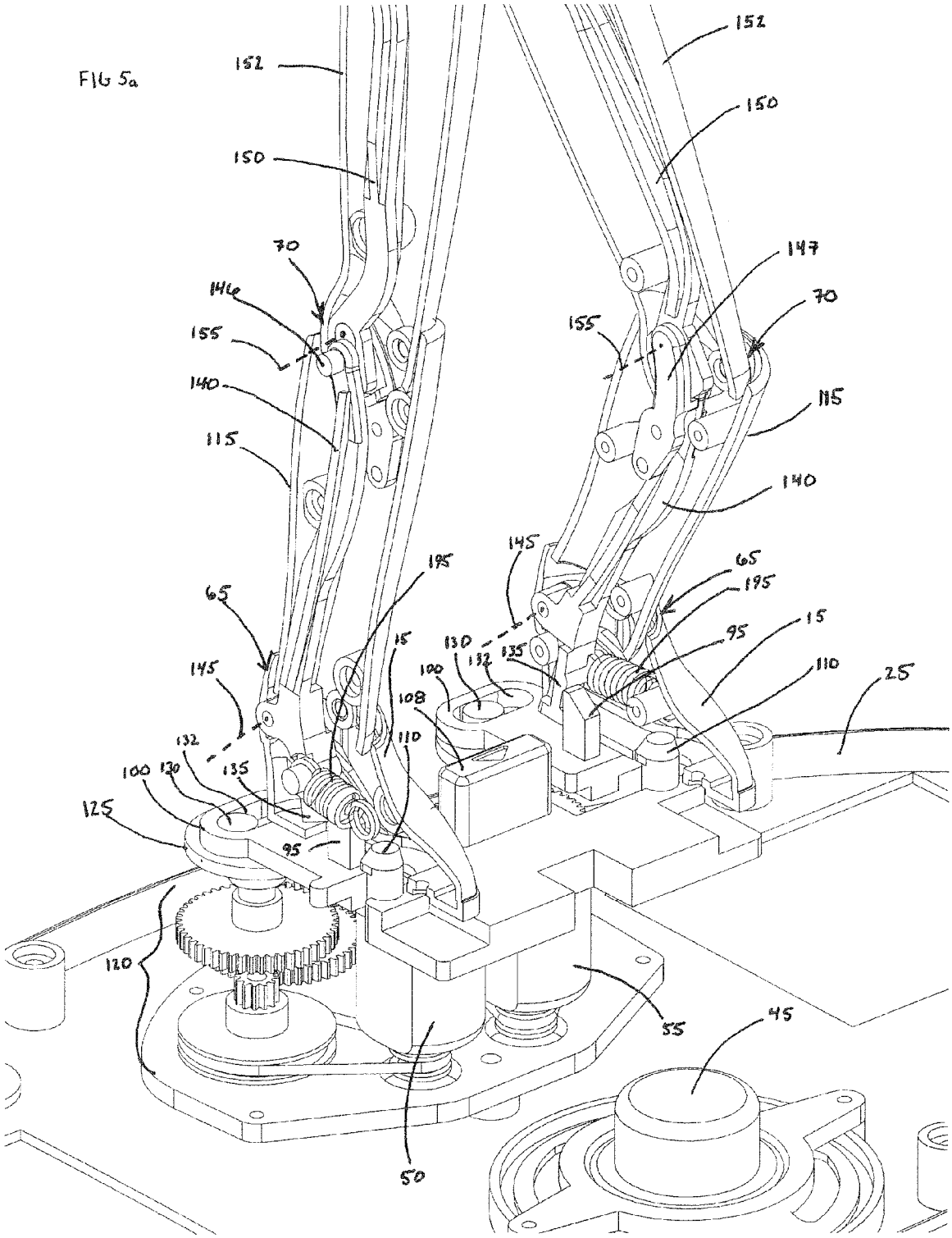
FIG. 5*a* is a front perspective view of the internal components of a figure and base, further showing the communication therebetween in accordance with an embodiment for a system to direct movement of a dancing figure.

Referring now also to FIG. 5*a*, as the gear trains 120 rotate the upper gears 125, the rotation linkages 100 reciprocate back and forth laterally, directed by the cam 130 and channel 132 relationship. As the rotation linkages 100 are moving laterally, the footprints 85 and posts 110 keep the boot housings 115 stationary, while the tab 95 slides back and forth along the channel 90, coming into contact with and moving a lower portion 135 of a calf linkage 140, which rotates the calf linkage 140 about axis 145. The calf linkage 140 is rotatably secured to the thigh housing 152 at axle pivot 146 (shown without the right side outer portions of the thigh housing 152 and boot housing 115 and the left side inner portions of thigh housing 152 and boot housing 115) and is freely rotatable about the axis 145 within the restraints of the boot housings 115. As the calf linkage 140 rotates, the movement is transferred to a thigh linkage 150, which is rotatably secured by knee connector 147 and is rotatable about axis 155 in the knee region 70.

Figure 5B:
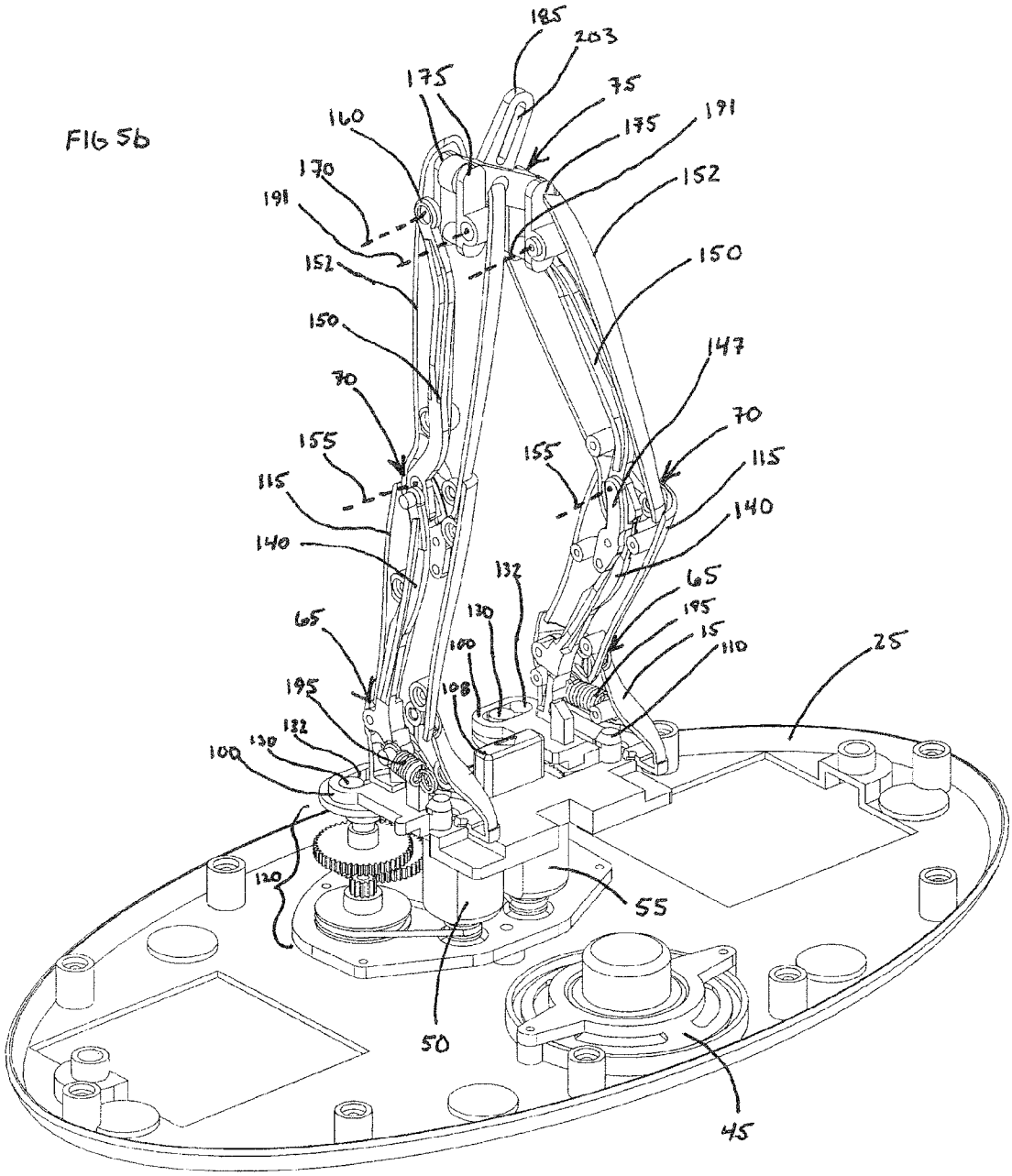
FIG. 5*b* is a front perspective view of the internal components of a figure and base in accordance with an embodiment for a system to direct movement of a dancing figure.
Figure 5E:
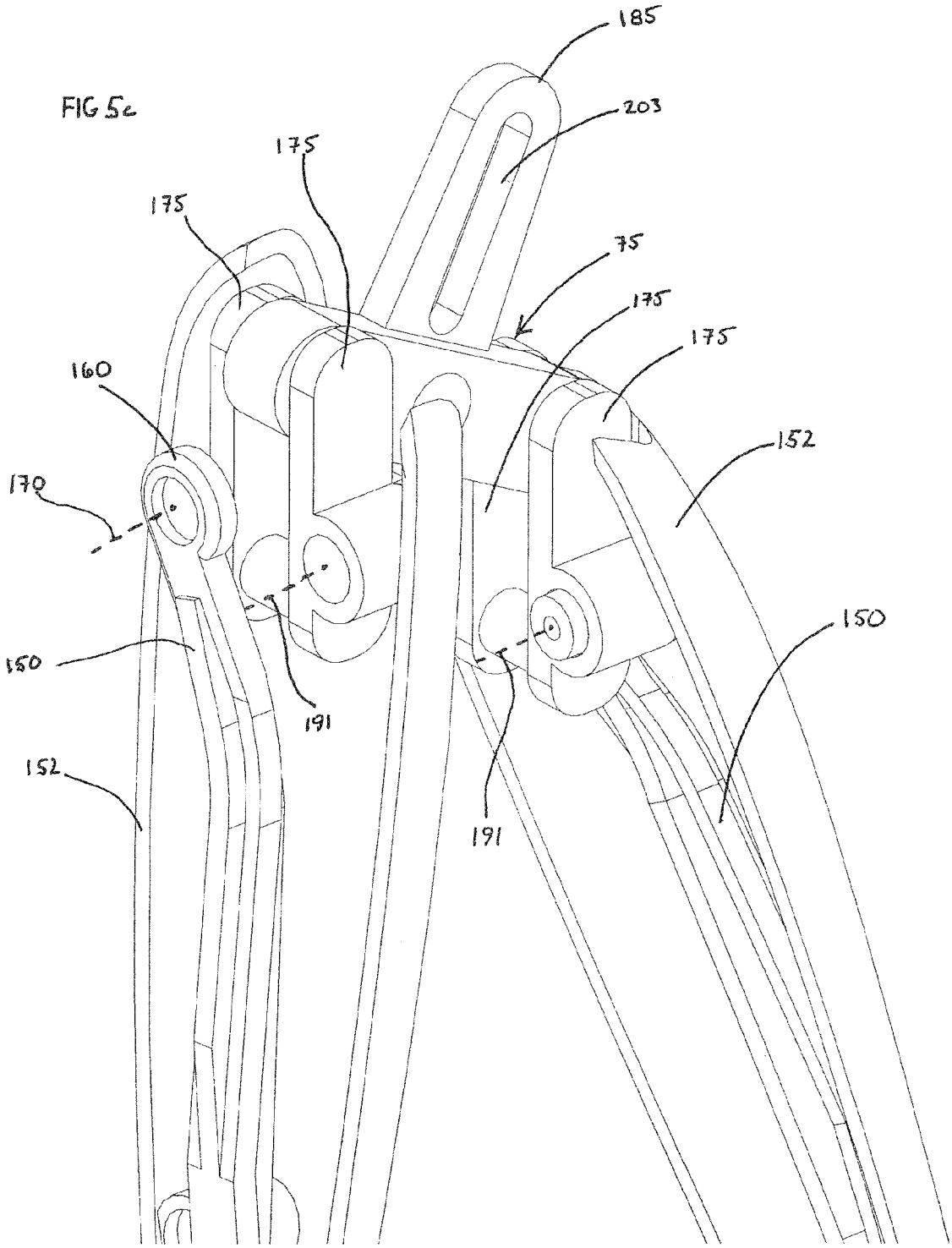
FIG. 5*c* is a front perspective view of a hip mechanism in accordance with an embodiment for a system to direct movement of a dancing figure.

Now additionally referring to FIGS. 5*b* and 5*c*, the upper portion 160 on the thigh linkage 150 is pivotally secured to the hip mechanism about axis 170. The hip mechanism or connector 175 is defined as having two pairs of vertical parallel sides 177 with the T-bar 185 pivotally connected therebetween, such that movement of the thigh linkages 150 is transferred to the T-bar 185 in a side to side rocking motion for movement of a torso (described below). Further, the two pairs of vertical sides 175 are pivotally secured to the thigh housing 152 such that the hip mechanism may rotate about axis 191, thus keeping the torso in a substantially upright position. As such, movement of the upper gears 125 on the gear trains 120 directs movement of the legs 60 back and forth, utilizing the pivot points in the ankle region 65 and the knee region 70 while the hip mechanism facilitates side to side movement via the relationship with the upper portions 160 of the thigh linkages 150 as described above. For continuous movement, the lower portion 135 of the calf linkage 140 has a spring 195 to return the calf linkage 140 to its original position.

Figure 6:
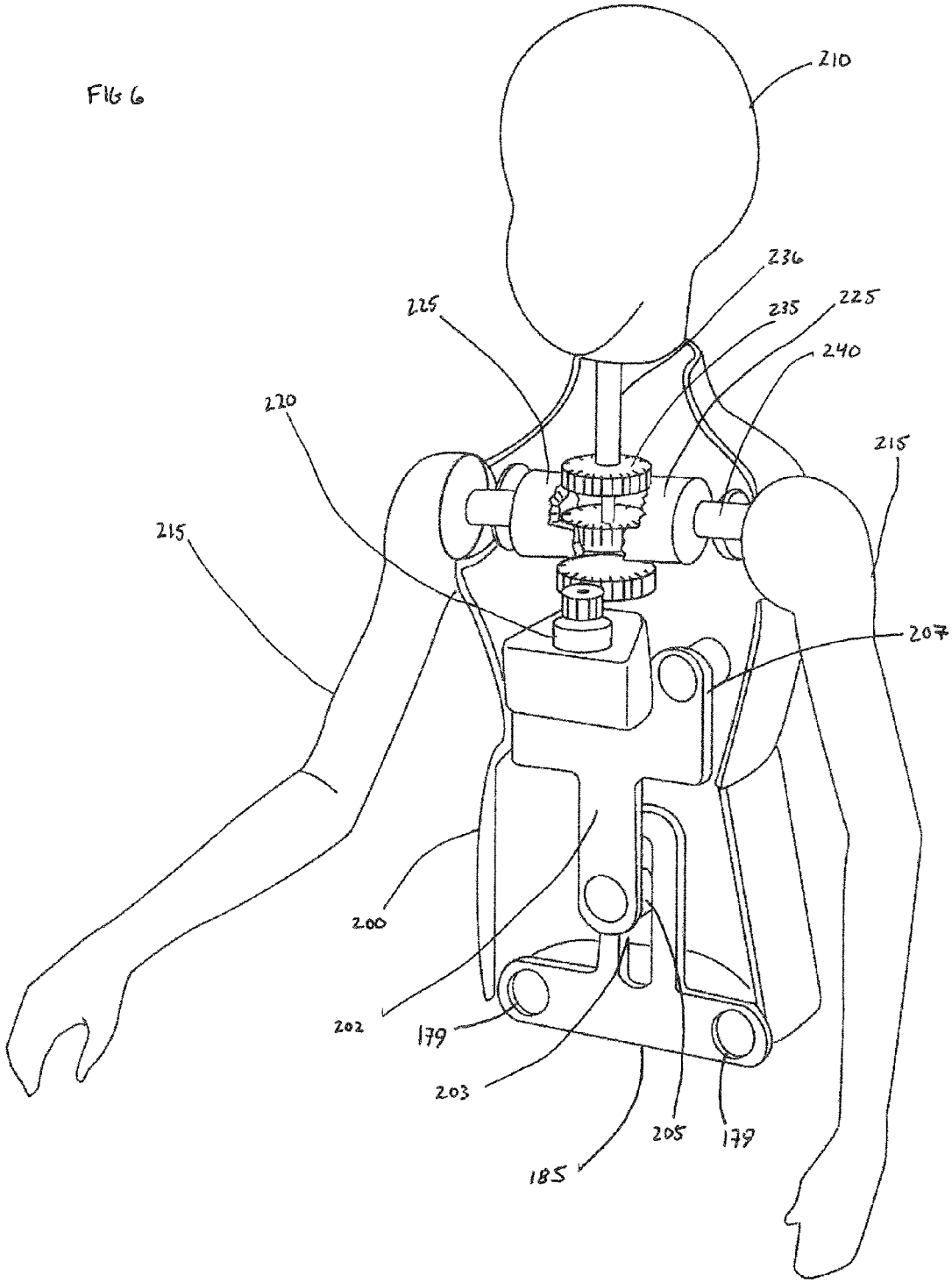
FIG. 6 is a front perspective view of a drive mechanism and gear combination positioned in the torso of a figure in accordance with an embodiment for a system to direct movement of a dancing figure.

Now referring back to FIG. 2 and additionally to FIG. 6, the torso drive mechanism is in communication with the power source 40 and the IC 35 for power and operational direction. When the third motor 220 is powered, the third motor 220 directs the combo gear 230 to spin such that the crown gears 225 and neck gear 235 rotate in accordance thereto.

In the first embodiment, the dancing figure and base include a means to trigger preprogrammed content including different dance maneuvers that incorporate movement of the legs, hips, arms and head of the dancing figure. Additionally, the first embodiment includes a means to manually control dance maneuvers that incorporate movement of the legs, hips, arms and head of the dancing figure. Also, the first embodiment includes a means to removeably attach the figure to the base. Further, the first embodiment includes a means to enable movement of the figure by utilizing a combination of gears, linkages and motors. Additionally, the first embodiment includes a means to simulate dance maneuvers utilizing pivots in the ankles, knees, and hips in combination with gears, linkages and motors.

Figure 7:
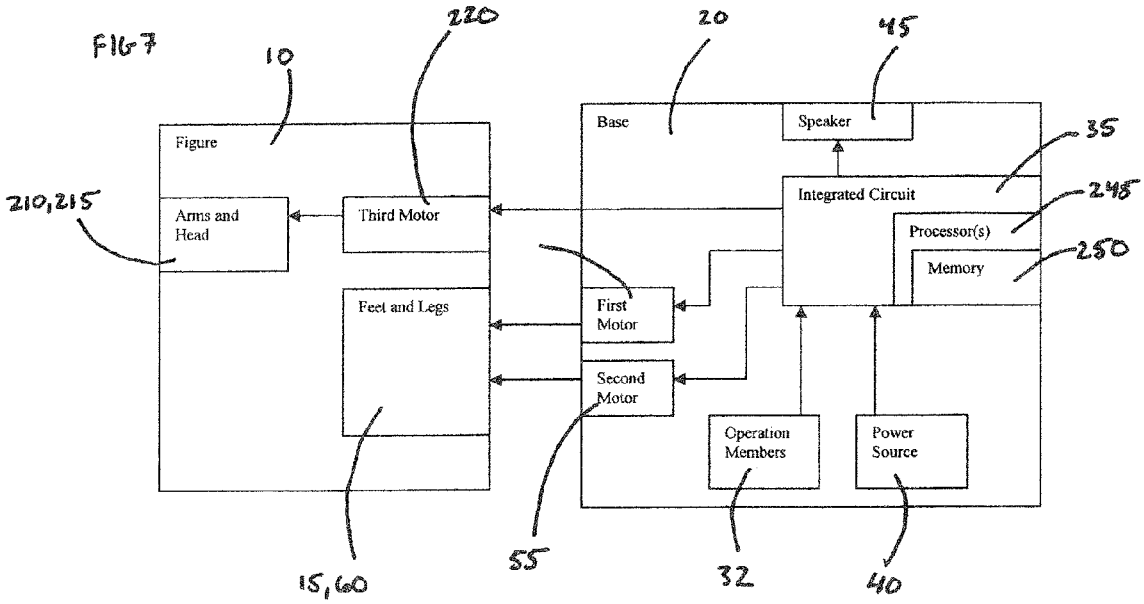
FIG. 7 is a block diagram of a dancing figure and base for an embodiment in accordance with the invention.

Referring now to FIG. 7, there is shown a block diagram provided for the first embodiment of the FIG. 10. The FIG. 10 includes the IC 35 that contains a processor(s) 245 and a memory 250. The processor(s) 245 accesses preprogrammed signals or audio content stored on the memory 250 in the IC 35. The IC 35 further includes programming and electronic components to facilitate and direct audio content, control signals and data. The processor(s) 245 in the IC 35 accesses the preprogrammed signals or audio content based on a program and/or in accordance to a user's input. The processor(s) 245 than generates a response that includes signals and may be in the form of audio or control signals. The IC 35 is in communication with the speaker 45, the first motor 50, the second motor 55, the third motor 220 and the power source 40. The base 20 would contain components well known in the art to facilitate control capabilities. For example, the base 20 may include the plurality of operation members 32 and processor(s) 245. The plurality of operation members 32 may trigger the selection of different songs and/or a specific dance that corresponds to a particular song. Additionally, the plurality of operation members 32 may include buttons to manually control the movement of the FIG. 10 based on a user's input. The IC 35 receives a user's input from the plurality of operation members 32 transferred through the aforementioned communication stream. From the processor(s) 245, audio signals are transferred to the speaker 45 while control signals are transferred to the first motor 50, the second motor 55 and the third motor 220 to direct the motors to power in a desired direction, based on a program and/or in accordance to a user's input or preprogrammed response. As such, a user can selectively distribute power to the drive mechanisms to direct the FIG. 10 to move in a variety of dance sequences. Further, as the drive mechanisms move, the movement is transferred throughout the FIG. 10 as described above.

It should further be contemplated that the FIG. 10 can include audio content and preprogrammed responses stored in the IC 35. The user may press a power button (or other triggering mechanism) to trigger the preprogrammed responses and audio content stored on the memory 250. The FIG. 10 in response can execute a performance pattern through movement and audio.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred.

We claim:

1. A system to direct movement of a dancing figure comprising:

a body defined by a torso, a head, and a pair of arms, a pair of legs pivotally attached to the torso at a hip region, each of the legs includes at least a thigh housing pivotally attached to a boot housing at a knee region, and a pair of feet pivotally attached to said boot housings at an ankle region;

a thigh linkage within the thigh housing, the thigh linkage including an upper portion pivotally attached to a hip mechanism defined in the hip region and a lower portion pivotally attached to the boot housing;

said pair of feet removeably attachable to a base, the base including two drive mechanisms, each in operable connection with a lower portion of a calf linkage pivotally attached to the foot at the ankle region, an upper portion of the calf linkage pivotally attached to the thigh housing, each calf linkage positioned within each of the boot housings that when activated independently pivot the boot housings forward and backward at said ankle region; and the base further comprising two linkages, each with a tab and a channel, each of the drive mechanisms including a motor operably connected to a gear train, the gear train further operably connected to an upper gear with a cam positioned in the channel such that when the drive mechanisms are powered, movement is transferred to the cams to move the linkages in a reciprocating lateral movement, said lateral movement driving the tab to contact said lower portion of the calf linkage to rotate the calf linkage about an axis defined by said lower portion, wherein said rotation of the calf linkage transfers movement to the boot housing, thigh housing and hip mechanism simulating animated movement of the figure.

2. The system of claim 1, wherein a torso mechanism is housed within the torso housing and in operable connection with a means to drive movement of the head and arms, such that when a motor included in the torso mechanism is powered, the head moves in a side to side motion while the arms move in an up and down motion.

3. The system of claim 2, wherein the hip mechanism includes a T-bar having ends pivotally joined to ends of a pair of vertical parallel sides forming a pivotal relationship, each of the vertical parallel sides is pivotally connected to the one of the thigh housings at the hip region, such that when one of the legs pivots, the pair of vertical parallel sides connected thereto pivots downwardly.

4. The system of claim 3, wherein the torso housing is attached to a Y-bar that extends upwardly from the hip mechanism, wherein when the hip mechanism pivots, the Y-bar pivots therewith, tilting the torso in accordance to the direction of the pivoting motion of the hip mechanism.

5. The system of claim 4, the base further comprising a controlling means for controlling each of the drive mechanisms separately and independently in accordance with preprogrammed instructions that control each of the drive mechanisms in a manner that simulates specific animated or dance like movement of the figure.

6. The system of claim 5, the controlling means further comprising:

a memory on an integrated circuit for storing audio content, control signals and data;

programming and electronic components to facilitate and direct audio content, control signals and data; and a plurality of operation members in operable connection with said programming and electronic components such that a user may direct operation of said drive mechanisms via said plurality of operation members.

7. A system to direct movement of a dancing figure, said system including an animated figure having a body, said body including a head, a torso housing, a pair of arms, a pair of legs pivotally connected to the torso housing to define a hip region, a pair of feet being separately and pivotally connected to the legs to define an ankle region, and each of the legs having at least a boot housing pivotally connected to a thigh housing to define a knee region, the animated figure further comprising:

a first and second drive mechanism in operable communication with each foot, each of the first and second drive mechanisms having a means for independently pivoting a lower portion of a calf linkage at the ankle regions in a forward and backward motion; and a third drive mechanism in operable communication with the head and the pair of arms, the third drive mechanism having a means for pivoting the head in a side to side motion and moving the pair of arms in an up and down motion, wherein the motions and movements simulate animated movement of the figure.

8. The system of claim 7, wherein the means for independently pivoting a lower portion of the calf linkage includes two linkages, each with a tab and a channel, each of the first and second drive mechanisms including a motor operably connected to a gear train, the gear train further operably connected to an upper gear with a cam positioned in the channel such that when the first and second drive mechanisms are powered, movement is transferred to the cams to move the linkages in a reciprocating lateral movement, said lateral movement driving the tabs to contact said lower portions of the calf linkages to rotate the calf linkages about an axis defined by a pivot point on said lower portion of the calf linkages, wherein said rotation of the calf linkages transfers movement to the boot housings, thigh housings and hip mechanism simulating animated movement of the figure.

9. The system of claim 8, wherein the means for pivoting the head and moving the arms further comprises:

a torso motor in operable connection with a gear combination to move the arms and head, said gear combination including a combo gear to transfer movement to a pair of crown gears attached to each of the arms, and a neck gear with a post attached to the head, such that when the torso motor is powered, the gear combination drives the arms to move up and down, and the head to pivot from side to side.

10. The system of claim 9, wherein the hip mechanism includes a T-bar having ends pivotally joined to ends of a pair of vertical parallel sides forming a pivotal relationship, each of the vertical parallel sides is pivotally connected to the legs such that when one of the legs pivots, the vertical parallel side connected thereto pivots downwardly.

11. The system of claim 10, wherein the torso housing is attached to a Y-bar that extends upwardly from the hip mechanism, wherein when the hip mechanism pivots, the Y-bar pivots therewith to cause the torso housing to move in accordance with the pivoting movement of the hip mechanism.

12. The system of claim 11, the figure further comprising a controlling means for controlling each of the drive mechanisms separately and independently in accordance with preprogrammed instructions that control each of the drive mechanisms in a manner that simulates specific animated or dance like movement in the figure.

13. The system of claim 12, the controlling means further comprising:

a memory on an integrated circuit for storing audio content, control signals and data;

programming and electronic components to facilitate and direct audio content, control signals and data;

said programming and electronic components in operable communication with said drive mechanisms; and a plurality of operation members in operable connection with said programming and electronic components such that a user may direct operation of said drive mechanisms via said plurality of operation members.

14. A system to direct movement of a dancing figure, the figure comprising a pivotal head, a pair of pivotal arms and a pair of pivotal legs connected to a torso housing at a hip region, each of the legs further being pivotally connected to a foot at an ankle region, a thigh linkage within a thigh housing, a calf linkage within a boot housing and including a lower portion pivotally attached to the foot at the ankle region and including an upper portion pivotally attached to the thigh housing at a knee region, the thigh linkage including an upper portion pivotally attached to a hip mechanism defined in the hip region and a lower portion pivotally attached to the boot housing; and a base comprising two linkages, each with a tab and a channel, each of two drive mechanisms including a motor operably connected to a gear train, the gear train further operably connected to an upper gear with a cam positioned in the channel such that when the drive mechanisms are powered, the cams move the two linkages in a reciprocating lateral movement, said lateral movement driving the tab to contact said lower portion of the calf linkage to rotate the calf linkage about an axis defined by said lower portion of the calf linkage, wherein said rotation of the calf linkage transfers movement to the boot housing, thigh housing and hip mechanism such that the figure simulates dance-like movements.

15. The system of claim 14, wherein a torso drive mechanism is in operable communication with the head and the pair of arms, the torso drive mechanism having a means for pivoting the head in a side to side motion and the pair of arms in an up and down motion, wherein the motion in the knee regions, hip region, arms and head region simulates animated movement of the figure.

16. The system of claim 15, wherein the means for pivoting the head and arms further comprises:

a torso motor in operable connection with a gear combination to move the arms and head, said gear combination including a combo gear to transfer movement to a pair of crown gears attached to each of the arms, and a neck gear with a post attached to the head, such that when the torso motor is powered, the gear combination drives movement of the arms and head.

17. The system of claim 16, the figure further comprising a controlling means for controlling each of the drive mechanisms separately and independently in accordance with preprogrammed instructions that control each of the drive mechanisms in a manner that simulates specific animated or dance like movement in the figure.

18. The system of claim 17, the controlling means further comprising:

a memory on an integrated circuit for storing audio content, control signals and data;

programming and electronic components to facilitate and direct audio content, control signals and data;

said programming and electronic components in operable communication with said drive mechanisms; and a plurality of operation members in operable connection with said programming and electronic components such that a user may direct operation of said drive mechanisms via said plurality of operation members.

* * * * *